US006945284B1

(12) United States Patent
Hurd et al.

(10) Patent No.: US 6,945,284 B1
(45) Date of Patent: Sep. 20, 2005

(54) DISPENSING CONTAINER FILL VALVE

(75) Inventors: Wayne R. Hurd, Old Saybrook, CT (US); Robert J. Ianarelli, Norwich, CT (US); Jeffrey T. Darling, Colchester, CT (US); Luis B. Carpio, Baltic, CT (US)

(73) Assignee: Longwood Engineered Products, Inc., Florham Park, NJ (US)

( * ) Notice: Subject to any disclaimer, the term of this patent is extended or adjusted under 35 U.S.C. 154(b) by 0 days.

(21) Appl. No.: 10/875,872

(22) Filed: Jun. 24, 2004

Related U.S. Application Data

(60) Provisional application No. 60/574,337, filed on May 25, 2004.

(51) Int. Cl.[7] ..... B65B 1/04

(52) U.S. Cl. ..... 141/2; 141/3; 141/20; 141/350; 53/470; 53/471

(58) Field of Search ..... 141/2, 3, 18, 20, 141/301, 113, 350; 53/470, 471

(56) References Cited

U.S. PATENT DOCUMENTS

| | | | | |
|---|---|---|---|---|
| 3,522,900 | A | 8/1970 | Nicholson | |
| 4,658,979 | A * | 4/1987 | Mietz et al. | 220/203.13 |
| 6,729,362 | B2 * | 5/2004 | Scheindel | 141/20 |

FOREIGN PATENT DOCUMENTS

| | | |
|---|---|---|
| EP | 0 227 049 | 7/1987 |

* cited by examiner

*Primary Examiner*—Steven O. Douglas
(74) *Attorney, Agent, or Firm*—Lerner, David, Littenberg, Krumholz & Mentlik, LLP

(57) ABSTRACT

A two-position fill valve for filling a pressurized dispensing container is disclosed. The valve includes a generally cylindrical body having a first end and a second end. The fill valve provides substantial improvements in both retaining area and fill area.

31 Claims, 11 Drawing Sheets

DISPENSING CONTAINER FILL VALVE

CROSS-REFERENCE TO RELATED APPLICATIONS

This application claims the priority of U.S. Provisional Patent Application No. 60/574,337, titled PRESSURIZED DISPENSING CONTAINER FILL VALVE, filed May 25, 2004, the entire disclosure of which is incorporated herein by reference.

FIELD OF THE INVENTION

The present invention relates to a two-position fill valve for a dispensing container, and in particular, to a two-position fill valve for an aerosol dispensing container.

BACKGROUND OF THE INVENTION

It is well known to utilize pressurized cans for dispensing products such as lotions and creams, for example, shaving cream. Generally these cans contain a product, for example shaving cream, and pressurized gas for expelling the product out of the container. The container is charged with the pressurized gas after placing the product in the container. Typically, a separate opening on the bottom of the container is utilized to introduce the pressurized gas into the container, and a plug or fill valve then is inserted into the opening to close the opening. Over the years, several advances in this process have occurred.

One such advance includes the use of a two-position plug or fill valve for performing this process. This two-position fill valve includes flutes on the side of the valve to provide access to the container when the plug is in a first position. A fill valve of this type is disclosed in U.S. Pat. No. 3,522,900 to Nicholson. FIGS. 1–3 illustrate the use of this two-position fill valve.

As shown in FIG. 1, the two-position fill valve initially is inserted into the container to a first position. This insertion typically is done at the facility where the container is manufactured. The container with the valve inserted then is transported to a filling facility. As shown in FIG. 1, the flutes within the two-position fill valve provide an opening into the container. At the filling facility, the container is pressurized through this opening, as shown in FIG. 2. Thereafter, as shown in FIG. 3, the valve is further inserted into the container to a second position where the valve seals the container. Although fill valves of this type have been used for many years, they present several problems.

An often encountered problem is the propensity of these valves to be dislodged from the container while in transit to the filler. This problem delays the manufacturing process and requires disposal of containers not having a valve. Another problem is the inability to quickly fill the containers. Productivity in the aerosol filling industry is based upon the number of containers filled per unit of time. Current two-position fill valves do not allow for a high propellant flow rate. Attempts to improve the fill rate generally have resulted in the valves being more easily dislodged from the containers, and vice versa.

A need exists, therefore, for an improved two-position fill valve that has a lower propensity to be dislodged from the containers and that also facilitates faster charging of the containers.

SUMMARY OF THE INVENTION

A two-position fill valve for a dispensing container is provided. The fill valve comprises a generally cylindrical body having a longitudinal axis, a first end and a second end. The body is adapted for insertion into a generally circular opening in the dispensing container in an insertion direction beginning at the first end. The body comprises a first tapered section extending from the first end toward the second end and has a first circumferential groove with an outwardly extending lip. The first tapered section increases in its radius transverse to the axis along at least a portion of its length between the first end and the lip. The first circumferential groove is adapted for securing the body in a first position within the circular opening for filling the container.

The body further comprises a second tapered section extending from the first circumferential groove toward the second end and having a second circumferential groove. The second tapered section increases in its radius transverse to the axis along at least a portion of its length between the first circumferential groove and the second circumferential groove. The second circumferential groove is adapted for securing the body in a second position within the circular opening to seal the opening following filling of the container.

The body also comprises at least one flute extending through the first circumferential groove and at least a portion of the first tapered section and the second tapered section. When the body is in the first position within the opening, the at least one flute defines a fill arc and a fill area of the opening for filling the dispensing container, and the area of the lip extending outwardly beyond the opening defines a retaining arc and a retaining area for holding the body in the opening. The fill area is greater than 15.0% percent of the total area of the opening, and the retaining area preferably is greater than 20.0% of the total area of the opening.

In a second embodiment, the ratio of the fill arc length to the retaining arc length is greater than 0.65. In a third embodiment, the at least one flute includes a convex section located substantially centrally within the flute.

The two-position fill valve of the present invention is easily inserted into a dispensing container. While in the first position, moreover, the fill valve has a lower propensity to become dislodged from the dispensing container and provides a substantially greater fill area.

DETAILED DESCRIPTION

A first embodiment for a two-position fill valve 10 in accordance with the present invention is shown in FIGS. 4–7. Fill valve 10 is intended to be inserted into a generally cylindrical opening 2 (shown in phantom in FIG. 6) in a dispensing container in the direction of the arrows shown in FIGS. 5A and 5B. Fill valve 10 is a unitary, molded element manufactured from a deformable material such as nitrile. Other materials can be used for manufacturing fill valve 10 that are deformable and enable fill valve 10 to be pressed into an opening in a dispensing container.

Figure 1:
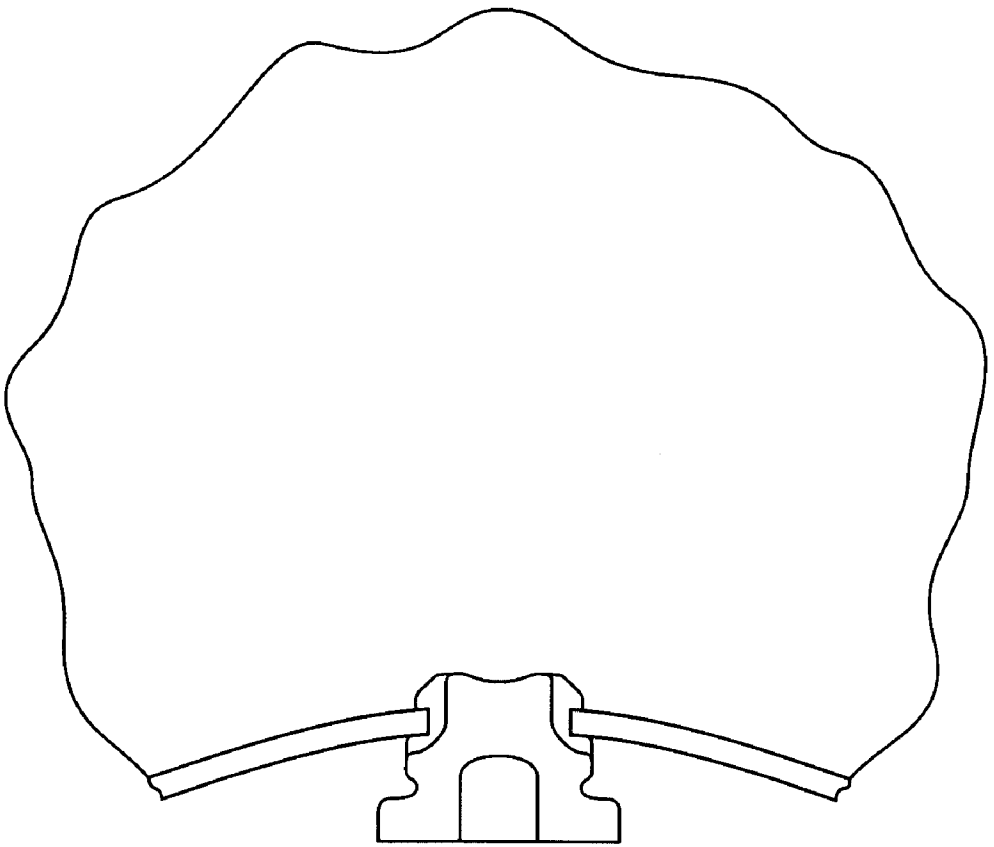
FIG. 1 Prior Art
FIG. 1 illustrates a two-position fill valve inserted in a first position in a dispensing container.
Figure 2:
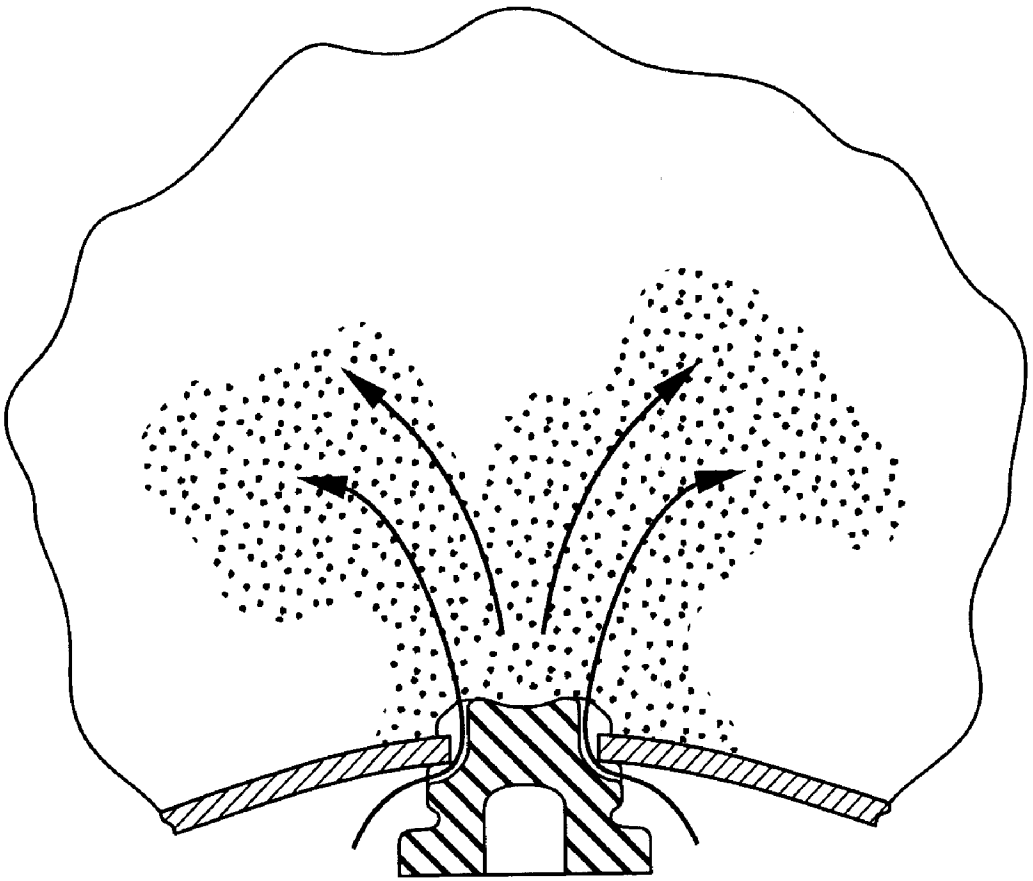
FIG. 2 Prior Art
FIG. 2 illustrates charging the dispensing container with pressurized gas while the two-position fill valve is in the first position.
Figure 3:
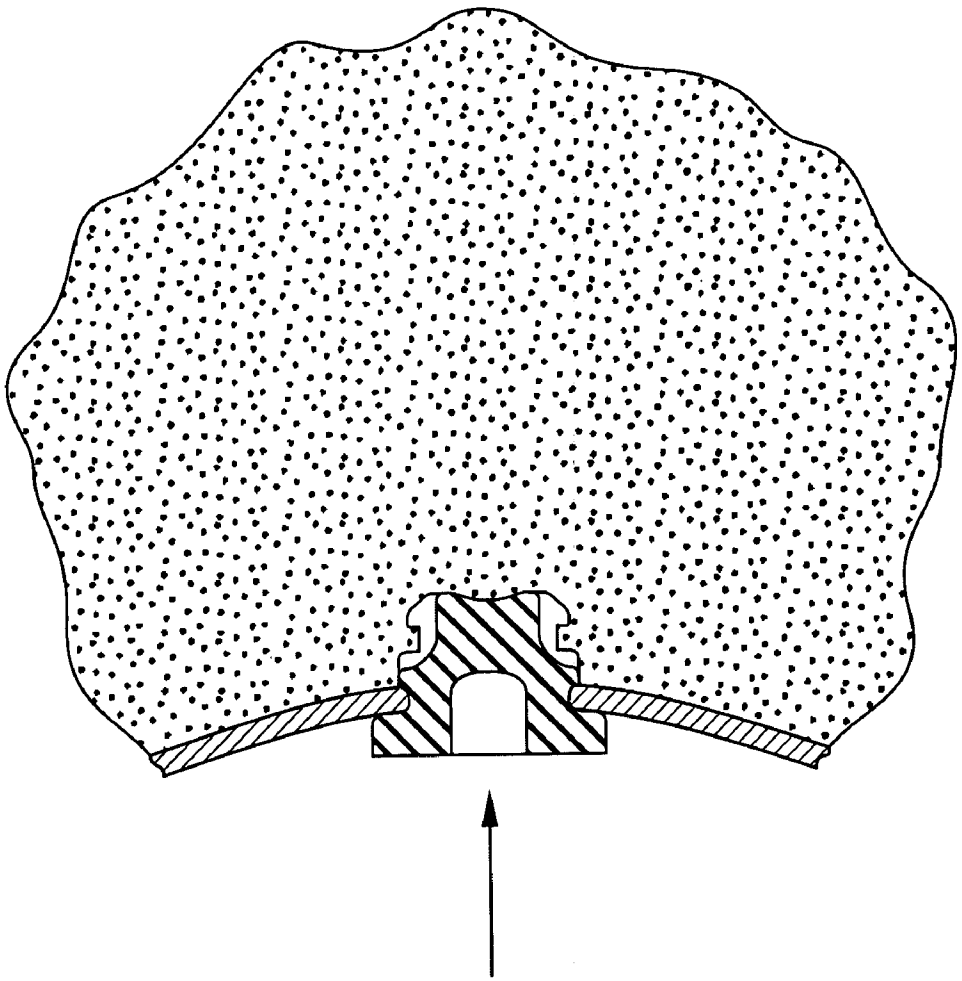
FIG. 3 Prior Art
FIG. 3 illustrates the two-position fill valve in a second position within the dispensing container to seal the dispensing container following charging with the pressurized gas.
Figure 4:
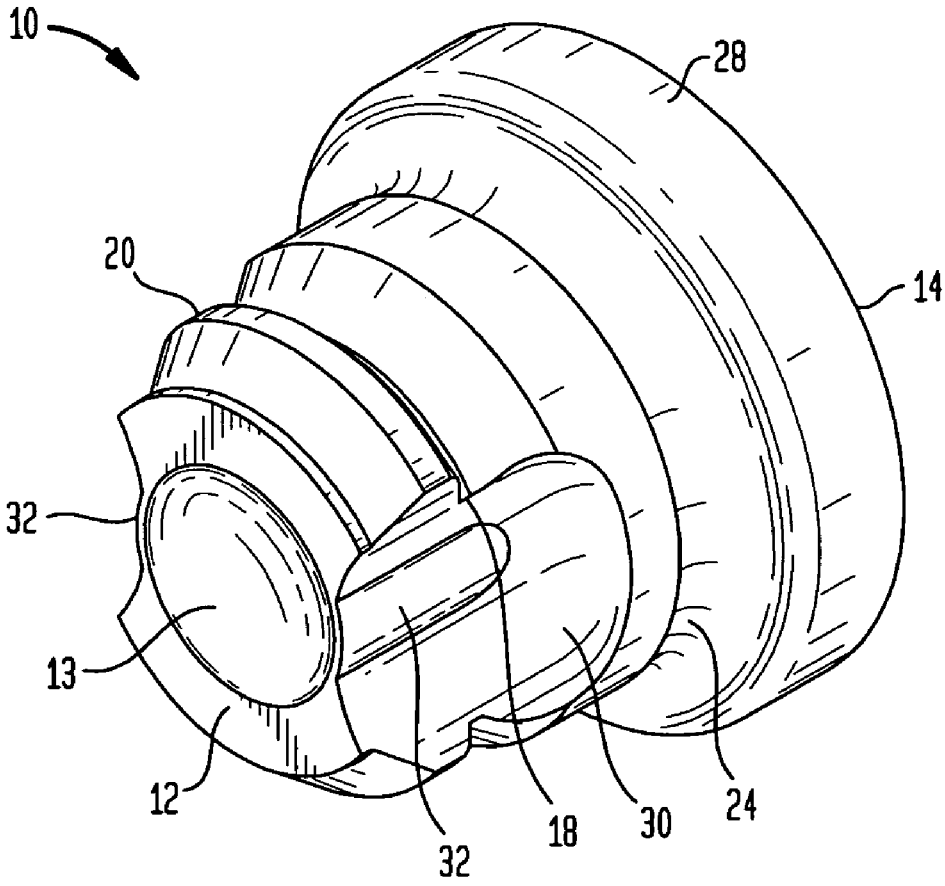
FIG. 4 is a side perspective view of a two-position fill valve according to an embodiment of the present invention.
Figure 5A:
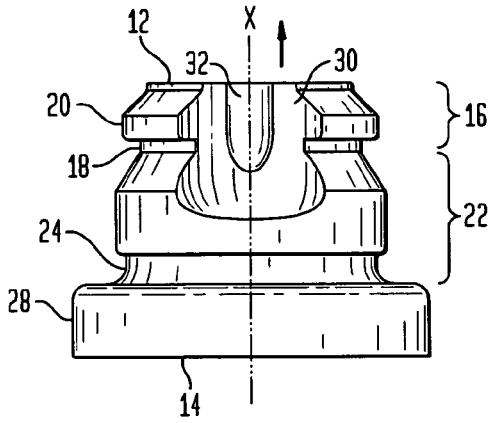
FIG. 5A is a side view of the fill valve of FIG. 4 showing a fluted side.
Figure 5B:
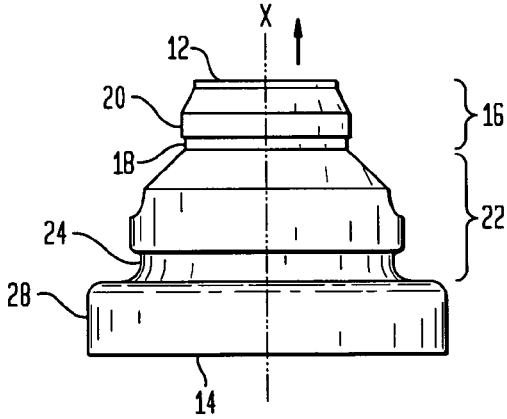
FIG. 5B is a side view of the fill valve of FIG. 4 showing a non-fluted side.

Fill valve 10 has a first end 12, a second end 14 and is generally cylindrical about its longitudinal axis X (shown in FIGS. 5A and 5B). Fill valve 10 includes a first tapered section 16 and a second tapered section 22 (also shown in FIGS. 5A and 5B). These sections extend from first end 12 along longitudinal axis X toward second end 14. First tapered section 16 includes a first circumferential groove 18 having an outwardly extending lip 20. Second tapered section 22 includes a second circumferential groove 24. Base section 28 is immediately below this second circumferential groove. Fill valve 10 also includes a cylindrical bore 34 (shown in FIG. 7) centered about axis X and extending from second end 14 into a substantial portion of fill valve 10. A cylindrical concave section 13, also centered about axis X and having substantially the same radius as cylindrical bore 34, extends from first end 12 slightly into fill valve 10.

The outer radius perpendicular to axis X of first tapered section 16 progressively increases from first end 12 to lip 20. This radius, however, may progressively increase for only a portion of this length. The radius then remains constant for a short distance to form lip 20. The radius then abruptly decreases to form first circumferential groove 18. First circumferential groove 18 secures fill valve 10 in a first position within opening 3 of a dispensing container (shown in phantom in FIG. 6) for filling the container.

The outer radius perpendicular to axis X of second tapered section 22 progressively increases from lip 20 along a first portion of its length from first circumferential groove 18 to base section 28 and remains constant along a second portion of this length. This radius, however, may progressively increase for both of these portions. Second tapered section 22 abruptly decreases immediately above base section 28 to form second circumferential groove 24. Second circumferential groove 24 secures fill valve 10 in a second position within opening 3 of the dispensing container. This second position seals the container following the container's filling.

Figure 6:
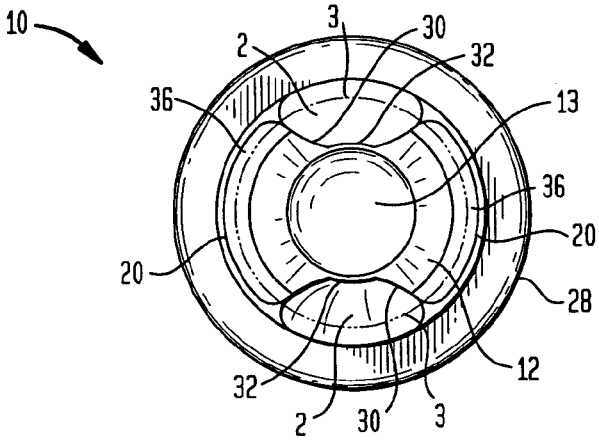
FIG. 6 is a top plan view of the fill valve of FIG. 4 shown inserted in a first position in an opening, shown in phantom, in a dispensing container.
Figure 7:
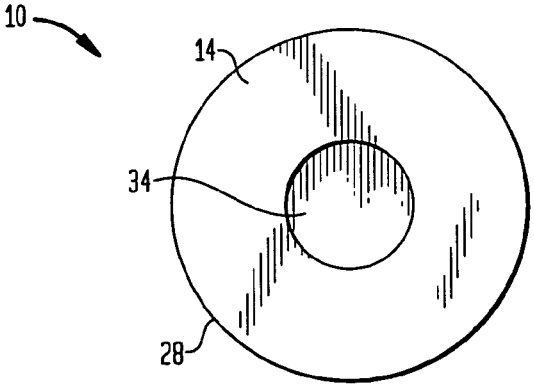
FIG. 7 is a bottom plan view of the fill valve of FIG. 4.

Two flutes 30, symmetrically spaced 180° apart about axis X, are formed within portions of first tapered section 16 and second tapered section 22. Each of these flutes includes a rounded convex section 32 centrally located within the flute. In the alternative, fill valve 10 may contain only one flute or more than two flutes. Also, the flutes may be spaced symmetrically or asymmetrically about axis X. As shown in FIG. 6, when fill valve 10 is in the first position within opening 3, flutes 30 provide a fill area 2 within opening 3. Fill area 2 is defined as the total area of the plane perpendicular to axis X surrounded by the flutes and the border of opening 3 when the fill valve is in the first position. This fill area provides two passageways into the dispensing container for filling the dispensing container with pressurized gas or other material.

As also shown in FIG. 6, first tapered section 16 extends through opening 3 when fill valve 10 is secured by circumferential groove 18 within opening 3 in the first position. The tapering of first section 16, and the deformability of fill valve 10, facilitate inserting fill valve 10 into opening 3 to this first position. In the first position, the portion of lip 20 extending beyond the walls of opening 3 provides a retaining area 36 that secures fill valve 10 within opening 3. Retaining area 36 is defined as the total area outside of opening 3 of the plane perpendicular to axis X surrounded by the border of opening 3 and the border of lip 20 when the fill valve is in the first position. This retaining area provides two sections on the bottom of lip 20 for securing fill valve 10 in the first position.

Figure 8:
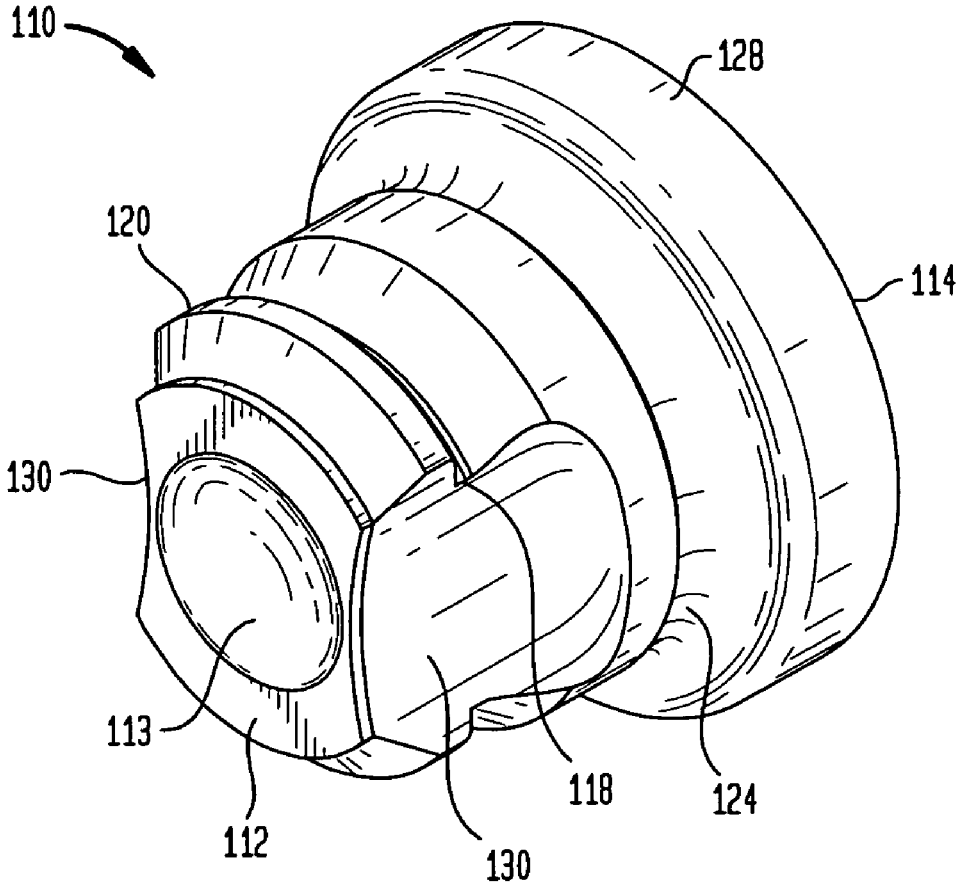
FIG. 8 is a side perspective view of a second embodiment of a two-position fill valve in accordance with the present invention.
Figure 9A:
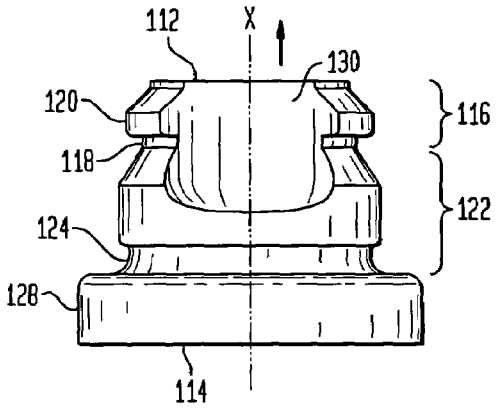
FIG. 9A is a side view of the fill valve of FIG. 8 showing a fluted side.
Figure 9B:
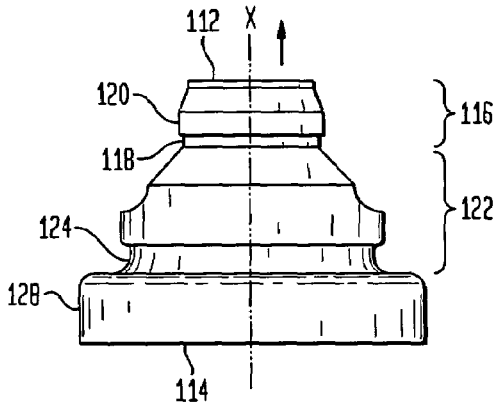
FIG. 9B is a side view of the fill valve of FIG. 8 showing a non-fluted side.
Figure 10:
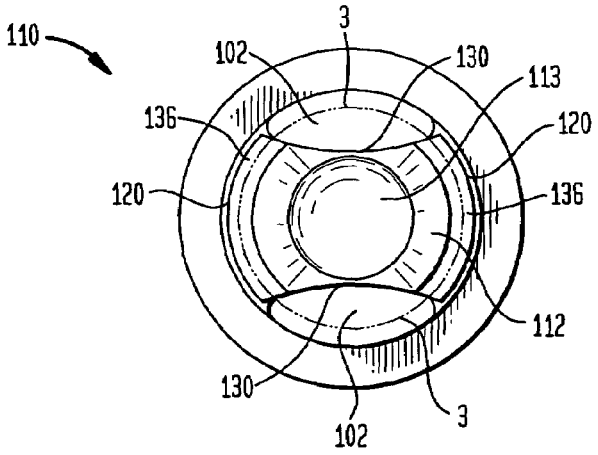
FIG. 10 is a top plan view of the fill valve of FIG. 8 shown inserted in a first position in an opening, shown in phantom, in a dispensing container.

A second embodiment for a two-position fill valve 110 in accordance with the present invention is shown in FIGS. 8–10. Fill valve 110 is similar to fill valve 10 except for the absence of convex sections on the flutes of fill valve 110.

Like fill valve 10, fill valve 110 has a first end 112, a second end 114 and is generally cylindrical about its longitudinal axis X (shown in FIGS. 9A and 9B). Fill valve 110 includes a first tapered section 116 and a second tapered section 122 (also shown in FIGS. 9A and 9B). These sections extend from first end 112 along longitudinal axis X toward second end 114. First tapered section 116 includes a first circumferential groove 118 having an outwardly extending lip 120. Second tapered section 122 includes a second circumferential groove 124. Base section 128 is immediately below this second circumferential groove. Fill valve 110 also includes a first cylindrical bore (not shown) centered about axis X and extending from second end 14 into a substantial portion of fill valve 110. A cylindrical concave section 113, also centered about axis X and having substantially the same radius as cylindrical bore 134, extends from first end 112 slightly into fill valve 110.

Like fill valve 10, the outer radius perpendicular to axis X of first tapered section 116 of fill valve 110 progressively increases from first end 112 to lip 120. This radius, however, may progressively increase for only a portion of this length. The radius then remains constant for a short distance to form lip 120. The radius then abruptly decreases to form first circumferential groove 118. First circumferential groove 118 secures fill valve 110 in a first position within opening 3 of a dispensing container (shown in phantom in FIG. 10) for filling the container.

The outer radius perpendicular to axis X of second tapered section 122 progressively increases from lip 120 along a first portion of its length from first circumferential groove 118 to base section 128 and remains constant along a second portion of this length. This radius, however, may progressively increase for both of these portions. Second tapered section 122 abruptly decreases immediately above base section 128 to form second circumferential groove 124. Second circumferential groove 124 secures fill valve 10 in a second position within opening 3 of the dispensing container. This second position seals the container following the container's filling.

Two flutes 130, symmetrically spaced 1800 apart about axis X, are formed within portions of first tapered section 116 and second tapered section 122. Unlike fill valve 10, however, the faces of these flutes are smooth and have no convex section. In the alternative, fill valve 110 may contain only one flute or more than two flutes. Also, the flutes may be spaced symmetrically or asymmetrically about axis X. As shown in FIG. 10, like fill valve 10, when fill valve 110 is in the first position within opening 3, flutes 130 provide a fill area 102 within opening 3. Fill area 102 is defined as the total area of the plane perpendicular to axis X surrounded by the flutes and the border of opening 3 when the fill valve is in this first position. This fill area provides two passageways into the dispensing container for filling the dispensing container with pressurized gas or other material.

As also shown in FIG. 10, first tapered section 116 extends entirely through opening 3 when fill valve 110 is secured by circumferential groove 118 within opening 3 in the first position. The tapering of first section 116, and the deformability of fill valve 110, facilitate inserting fill valve 110 into opening 3 to this first position. In the first position, the portion of lip 120 extending beyond the walls of opening 3 provides a retaining area 36 that secures fill valve 110 within opening 3. Retaining area 136 is defined as the total area outside of opening 3 of the plane perpendicular to axis X surrounded by the border of opening 3 and the border of lip 120 when the fill valve is in the first position. This retaining area provides two sections on the bottom of lip 120 for securing fill valve 110 in the first position.

Figure 11:
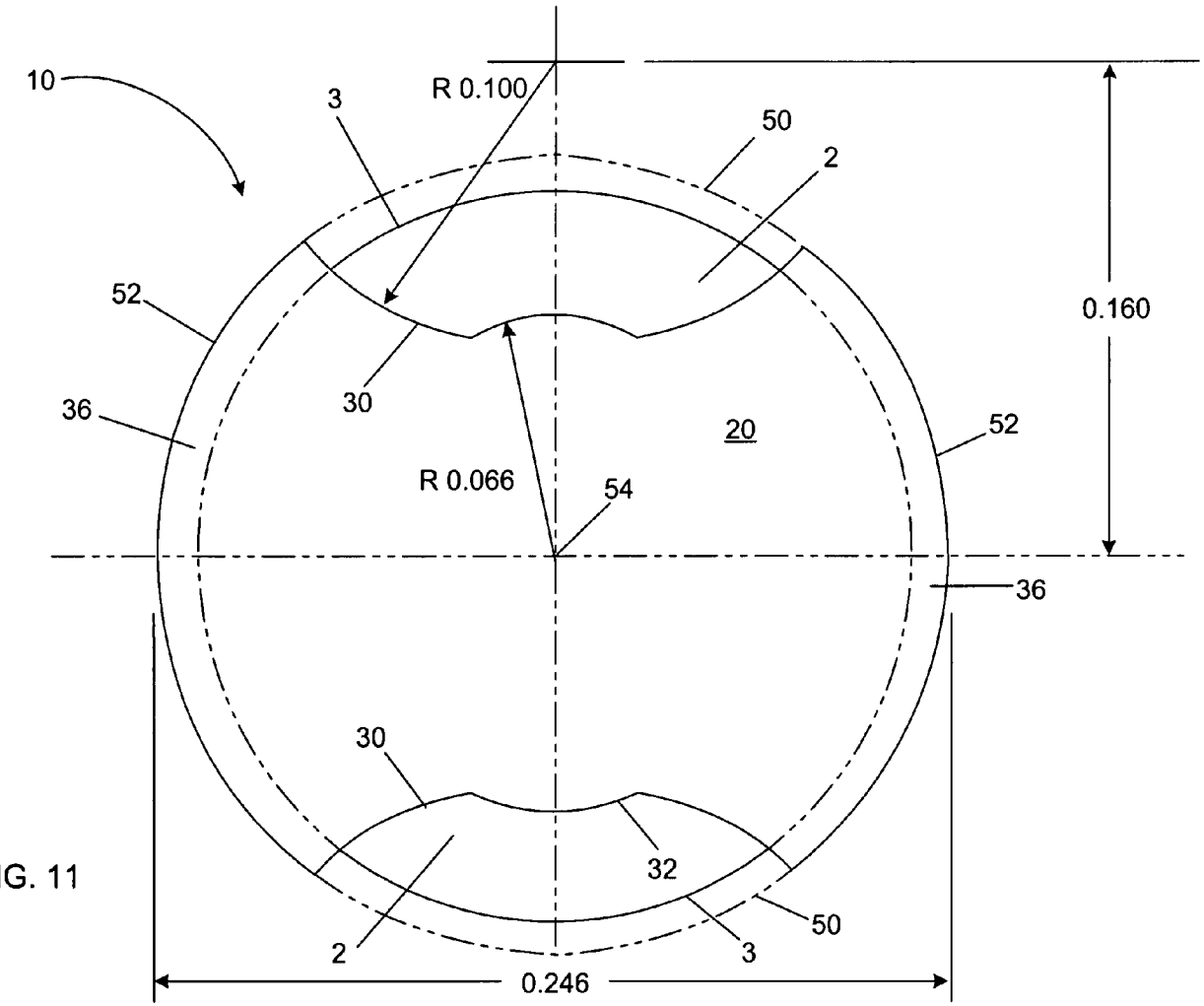
FIG. 11 is a schematic top plan view of the fill valve of FIGS. 4–7 showing the dimensions of this fill valve for a fill-valve opening of standard size in a dispensing container.

The standard radius in the aerosol industry for circular opening 3 is 0.105 inches. The standard area for such an opening, therefore, is 0.035 square inches. The dimensions of flutes 30 and lip 20 for fill valve 10 for such a standard opening are shown in FIG. 11. FIG. 11 is a cross-sectional view of lip 20 perpendicular to axis X with fill valve 10 in the first position within opening 3. Lip 20 has a radius of 0.123 inches and, therefore, a diameter of 0.246 inches. The radius of flutes 30 is 0.100 inches drawn from a point along the centerline of lip 20 that is 0.160 inches from the center 54 of lip 20. The radius of the convex sections 32 is 0.066 inches drawn from the center 54 of lip 20. The area of fill area 2 is 0.0073 square inches, and the area of retaining area 36 is 0.0074 square inches. Fill area 2 is 20.9% of the area of opening 3, and retaining area 36 is 21.1% of the total area of opening 3.

The border of lip 20 perpendicular to axis X comprises two arcs 52. The extension of these arcs on the plane perpendicular to axis X through the portions of lip 20 removed to form flutes 30 results in a circle. The portions of this circle removed to form flutes 30 comprise two removed arcs 50. The fill arc length is defined as the total length of removed arcs 50, and the retaining arc length is defined as the total length of arcs 52. For fill valve 10 for a standard opening having a radius of 0.105 inches, the retaining arc length is 0.439 inches and the fill arc length is 0.334 inches. The ratio of the fill arc length to the retaining arc length, therefore, is 0.761.

Figure 12:
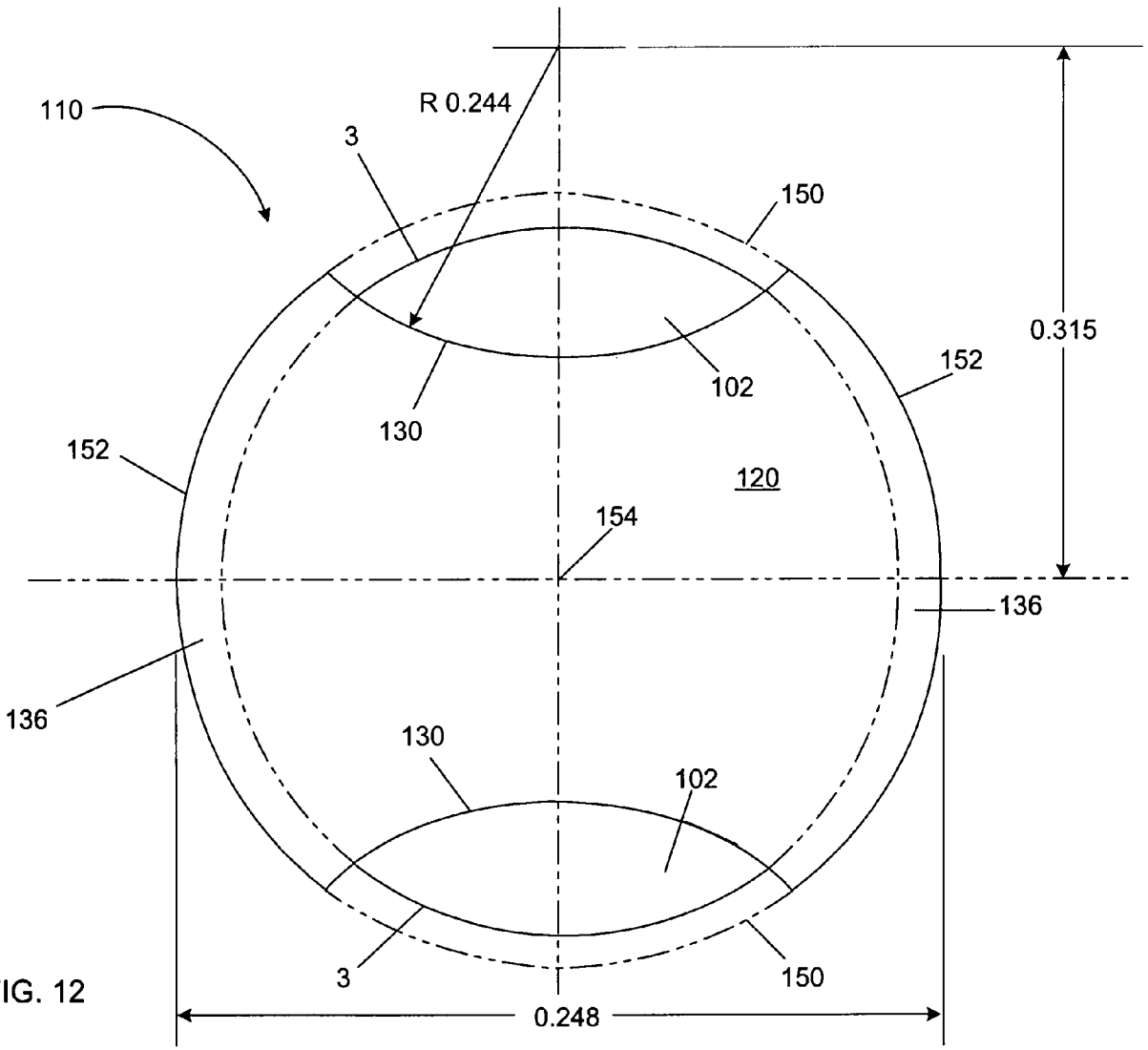
FIG. 12 is a schematic top plan view of the fill valve of FIGS. 8–10 showing the dimensions of this fill valve for a fill-valve opening of standard size in a dispensing container.

The dimensions of flutes 130 and lip 120 for fill valve 110 for a standard opening are shown in FIG. 12. FIG. 12 is a cross-sectional view perpendicular to axis X of lip 120 with fill valve 110 in the first position within opening 3. The radius of lip 120 is 0.124 inches and, therefore, lip 120 also has a diameter of 0.248 inches. The radius of flutes 130 is 0.244 inches drawn from a point along the centerline of lip 120 that is 0.315 inches from the center 154 of lip 120. The fill area 102 of fill valve 110 is 0.0057 square inches, and the retaining area 136 of fill valve 110 is 0.0071 square inches. Fill area 102 is 16.3% of the area of opening 3, and retaining area 136 is 20.3% of the total area of opening 3.

For fill valve 110, the retaining arc length is the total length of arcs 152, and the fill arc length is the total length of removed arcs 150. For fill valve 110 for a standard opening having a radius of 0.105 inches, the retaining arc length is 0.390 inches and the fill arc length is 0.388 inches. The ratio of the fill arc length to the retaining arc length, therefore, is 0.995.

Figure 13:
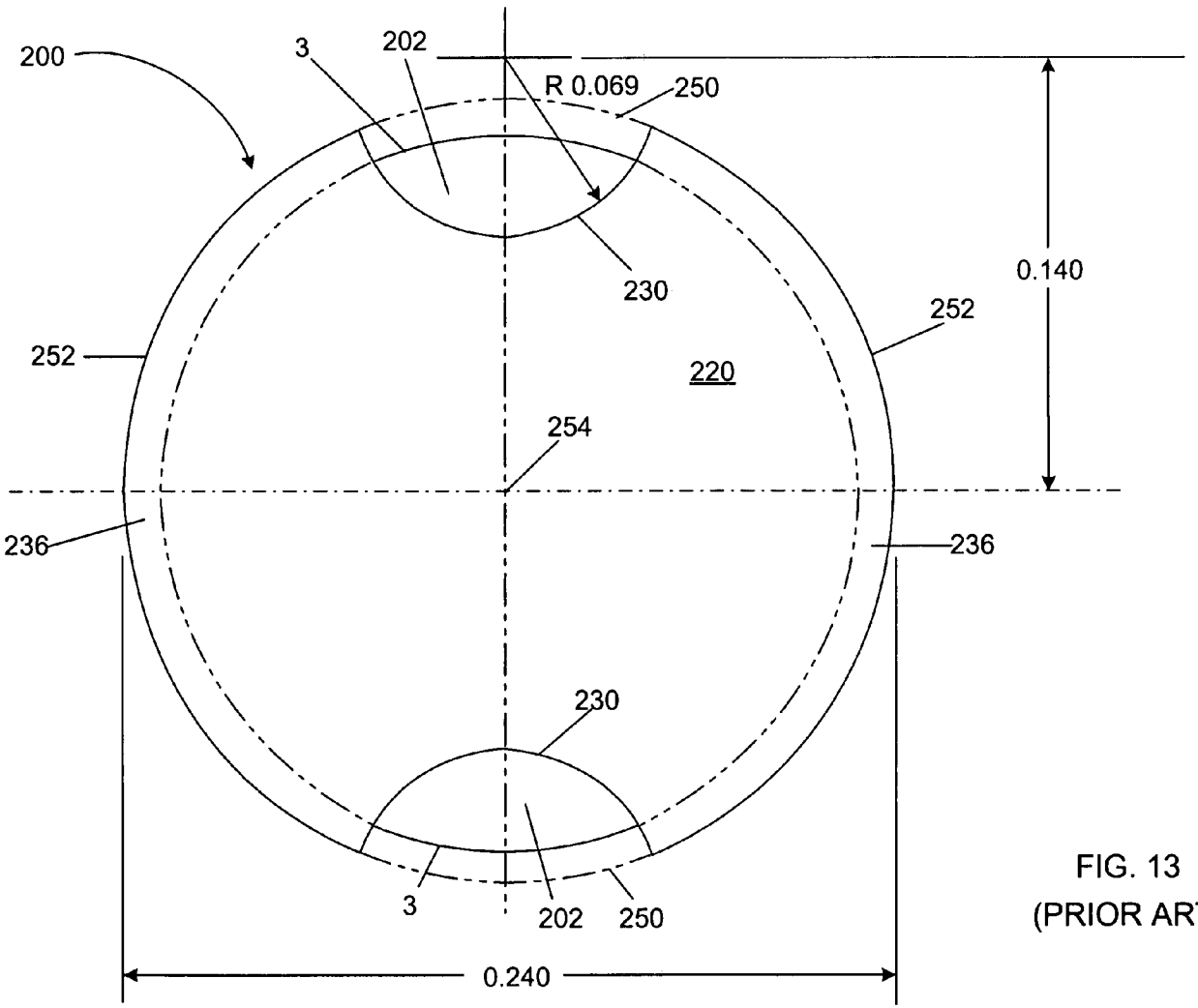
FIG. 13 (PRIOR ART)
FIG. 13 is a schematic top plan view of a prior art two-position fill valve showing the dimensions of this fill valve for a fill-valve opening of standard size in a dispensing container.

For comparison, the dimensions of flutes 130 and lip 120 for a prior art, two-position fill valve 200 for a standard opening are shown in FIG. 13. FIG. 13 is a cross-sectional view perpendicular to axis X of lip 220 of prior art fill valve 200 with fill valve 200 in the first position within opening 3. The radius of lip 220 is 0.120 inches and, therefore, lip 220 has a diameter of 0.240 inches. The radius of flutes 230 is 0.069 inches drawn from a point along the centerline of lip 220 that is 0.140 inches from the center 254 of lip 220. The fill area 202 of fill valve 200 is 0.0044 square inches, and the retaining area 236 of fill valve 200 is 0.0070 square inches. Therefore, fill area 202 is only 12.6% of the area of opening 3, and retaining area 236 is 20.0% of the total area of opening 3.

For fill valve 200, the retaining arc length is the total length of arcs 252, and the fill arc length is the total length of removed arcs 250. For fill valve 200 for a standard opening having a radius of 0.105 inches, the retaining arc length is 0.502 inches and the fill arc length is 0.252 inches. The ratio of the fill arc length to the retaining arc length, therefore, is 0.502.

Figure 14:
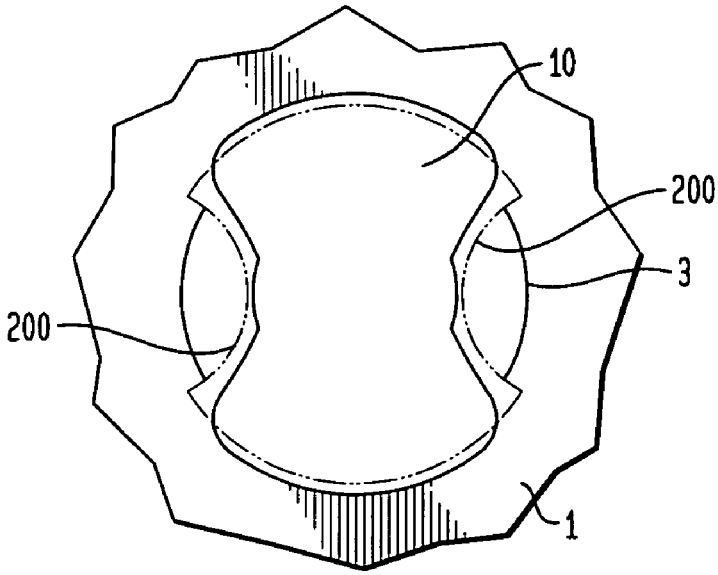
FIG. 14 is schematic top plan view comparing the fill valve of FIGS. 4–7 with the prior art two-position fill valve, both shown inserted in a first position in an opening in a dispensing container.
Figure 15:
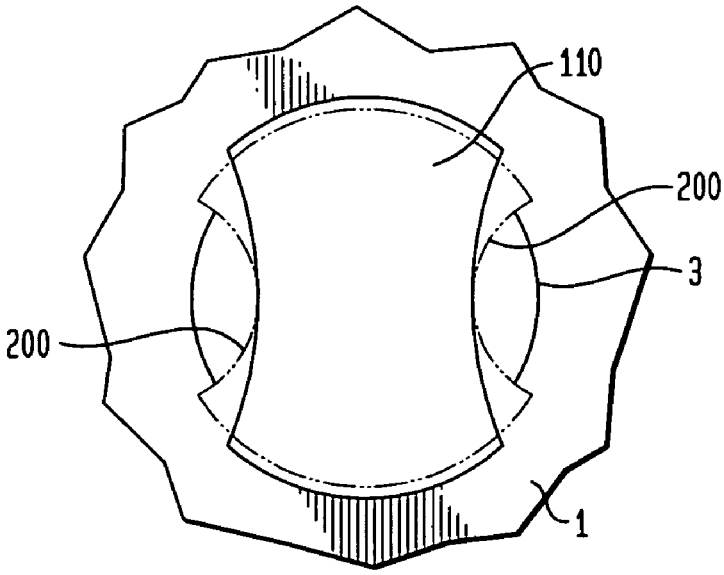
FIG. 15 is schematic top plan view comparing the fill valve of FIGS. 8–10 with the prior art two-position fill valve, both shown inserted in a first position in an opening in a dispensing container.

FIG. 14 is a top plan view of fill valve 10 in the first position within opening 3 of container 1 with prior art fill valve 200 in the first position within opening 3 shown in phantom for comparison. FIG. 15 is a similar top plan view of fill valve 110 in the first position within opening 3 of container 1 with prior art fill valve 200 in the first position within opening 3 shown in phantom for comparison.

As can be seen from these figures, the radius of the lip of fill valves 10 and 110 is in each case greater than that of the lip of prior art fill valve 200. Fill valves 10 and 110 nevertheless are easily inserted into opening 3 of container 1. As also can be seen from these figures, the retaining arc length of fill valves 10 and 110 is in each case substantially shorter than that of prior art fill valve 200. For prior art fill valve 200, the ratio of the fill arc length to the retaining arc length is only 0.502. The ratio of the fill arc length to the retaining arc length for both fill valve 10 and fill valve 110, on the other hand, is substantially greater than 0.650. Fill valves 10 and 110 nevertheless have a greater retaining area than that of prior art fill valve 200 and, therefore, are less likely to become dislodged from opening 3 while in the first position. In addition, as also can be seen from these figures, notwithstanding that the retaining area of fill valves 10 and 110 is greater than that of prior art fill valve 200, the fill area of fill valves 10 and 110 is substantially greater than that of prior art fill valve 200. The fill area of prior art fill valve 200 is only 12.6% of the area of opening 3. The fill area of both fill valve 10 and fill valve 110, on the other hand, is substantially greater than 15.0%. As a result, aerosol containers using fill valves 10 and 110 can be filled much faster than aerosol containers using prior art fill valve 200 and with less manufacturing delays caused by dislodged fill valves.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A two-position fill valve for a dispensing container, comprising:

a generally cylindrical body having a longitudinal axis, a first end and a second end, the body being adapted for insertion into a generally circular opening in the dispensing container in an insertion direction beginning at the first end, the body comprising;

a first tapered section extending from the first end toward the second end and having a first circumferential groove with an outwardly extending lip, the first tapered section increasing in its radius transverse to the axis along at least a portion of its length between the first end and the lip, the first circumferential groove being adapted for securing the body in a first position within the circular opening for filling the container;

a second tapered section extending from the first circumferential groove toward the second end and having a second circumferential groove, the second tapered section increasing in its radius transverse to the axis along at least a portion of its length between the first circumferential groove and the second circumferential groove, the second circumferential groove being adapted for securing the body in a second position within the circular opening to seal the opening following filling of the container;

at least one flute extending through the first circumferential groove and at least a portion of the first tapered section and the second tapered section;

wherein when the body is in the first position within the opening, the at least one flute defines a fill arc and a fill area of the opening for filling the dispensing container, and the area of the lip extending outwardly beyond the opening defines a retaining arc and a retaining area for holding the body in the opening, the fill area being greater than 15.0% percent of the total area of the opening.

2. The two-position fill valve of claim 1, wherein the retaining area is greater than 20.0% of the total area of the opening.

3. The two-position fill valve of claim 1, wherein the ratio of the fill arc length to the retaining arc length is greater than 0.51.

4. The two-position fill valve of claim 1, wherein the number of flutes is two, and the two flutes are symmetrically spaced approximately 180° apart about the longitudinal axis.

5. The two-position fill valve of claim 1, wherein the fill area is approximately 20.9% percent of the total area of the opening and the retaining area is approximately 21.1% of the total area of the opening.

6. The two-position fill valve of claim 5, wherein the ratio of the fill arc length to the retaining arc length is approximately 0.76.

7. The two-position fill valve of claim 1, wherein the at least one flute includes a convex section located substantially centrally within the flute.

8. The two-position fill valve of claim 4, wherein each of the flutes includes a convex section located substantially centrally within the flute.

9. The two-position fill valve of claim 1, wherein the fill area is approximately 16.3% percent of the total area of the opening and the retaining area is approximately 20.3% of the total area of the opening.

10. The two-position fill valve of claim 9, wherein the ratio of the fill arc length to the retaining arc length is approximately 0.995.

11. The two-position fill valve of claim 1, wherein the second end comprises a generally cylindrical base having a radius transverse to the axis substantially greater than the circular opening to seal the circular opening following filling of the container.

12. The two-position fill valve of claim 1, wherein the fill valve is constructed of nitrile.

13. A two-position fill valve for a dispensing container, comprising:

a generally cylindrical body having a longitudinal axis, a first end and a second end, the body being adapted for insertion into a generally circular opening in the dispensing container in an insertion direction beginning at the first end, the body comprising;

a first tapered section extending from the first end toward the second end and having a first circumferential groove with an outwardly extending lip, the first tapered section increasing in its radius transverse to the axis along at least a portion of its length between the first end and the lip, the first circumferential groove being adapted for securing the body in a first position within the circular opening for filling of the container;

a second tapered section extending from the first circumferential groove toward the second end and having a second circumferential groove, the second tapered section increasing in its radius transverse to the axis along at least a portion of its length between the first circumferential groove and the second circumferential groove, the second circumferential groove being adapted for securing the body in a second position within the circular opening to seal the opening following filling the container;

at least one flute extending through the first circumferential groove and at least a portion of the first tapered section and the second tapered section;

wherein when the body is in the first position within the opening, the at least one flute defines a fill arc and a fill area of the opening for filling the dispensing container, and the area of the lip extending outwardly beyond the opening defines a retaining arc and a retaining area for holding the body in the opening, the ratio of the fill arc length to the retaining arc length being greater than 0.65.

14. The two-position fill valve of claim 13, wherein the number of flutes is two, and the two flutes are symmetrically spaced approximately 180° apart about the longitudinal axis.

15. The two-position fill valve of claim 13, wherein the fill area is approximately 20.9% percent of the total area of the opening and the retaining area is approximately 21.1% of the total area of the opening.

16. The two-position fill valve of claim 15, wherein the ratio of the fill arc length to the retaining arc length is approximately 0.76.

17. The two-position fill valve of claim 13, wherein the at least one flute includes a convex section located substantially centrally within the flute.

18. The two-position fill valve of claim 14, wherein each of the flutes includes a convex section located substantially centrally within the flute.

19. The two-position fill valve of claim 13, wherein the fill area is approximately 16.3% percent of the total area of the opening and the retaining area is approximately 20.3% of the total area of the opening.

20. The two-position fill valve of claim 19, wherein the ratio of the fill arc length to the retaining arc length is approximately 0.995.

21. The two-position fill valve of claim 13, wherein the second end comprises a generally cylindrical base having a radius transverse to the axis substantially greater than the circular opening to seal the circular opening following filling of the container.

22. The two-position fill valve of claim 13, wherein the fill valve is constructed of nitrile.

23. A two-position fill valve for a dispensing container, comprising:

a generally cylindrical body having a longitudinal axis, a first end and a second end, the body being adapted for insertion into a generally circular opening in the dispensing container in an insertion direction beginning at the first end, the body comprising;

a first tapered section extending from the first end toward the second end and having a first circumferential groove with an outwardly extending lip, the first tapered section increasing in its radius transverse to the axis along at least a portion of its length between the first end and the lip, the first circumferential groove being adapted for securing the body in a first position within the circular opening for filling of the container;

a second tapered section extending from the first circumferential groove toward the second end and having a second circumferential groove, the second tapered section increasing in its radius transverse to the axis along at least a portion of its length between the first circumferential groove and the second circumferential groove, the second circumferential groove being adapted for securing the body in a second position within the circular opening to seal the opening following filling the container;

at least one flute extending through the first circumferential groove and at least a portion of the first tapered section and the second tapered section;

wherein when the body is in the first position within the opening, the at least one flute defines a fill arc and a fill area of the opening for filling the dispensing container, and the area of the lip extending outwardly beyond the opening defines a retaining arc and a retaining area for holding the body in the opening, the at least one flute including a convex section located substantially centrally within the flute.

24. The two-position fill valve of claim 23, wherein the fill area is greater than 12.6% percent of the total area of the opening and the retaining area is greater than 20.0% of the total area of the opening.

25. The two-position fill valve of claim 23, wherein the ratio of the fill arc length to the retaining arc length is greater than 0.51.

26. The two-position fill valve of claim 23, wherein the number of flutes is two, the two flutes are symmetrically spaced approximately 180° apart about the longitudinal axis and each of the flutes includes a convex section located substantially centrally within the flute.

27. The two-position fill valve of claim 23, wherein the fill area is approximately 20.9% percent of the total area of the opening.

28. The two-position fill valve of claim 27, wherein the retaining area is approximately 21.1% of the total area of the opening.

29. The two-position fill valve of claim 28, wherein the ratio of the fill arc length to the retaining arc length is approximately 0.76.

30. The two-position fill valve of claim 23, wherein the second end comprises a generally cylindrical base having a radius transverse to the axis substantially greater than the circular opening to seal the circular opening following filling of the container.

31. The two-position fill valve of claim 23, wherein the fill valve is constructed of nitrile.

* * * * *

UNITED STATES PATENT AND TRADEMARK OFFICE

CERTIFICATE OF CORRECTION

PATENT NO. : 6,945,284 B1
DATED : September 20, 2005
INVENTOR(S) : Wayne R. Hurd et al.

It is certified that error appears in the above-identified patent and that said Letters Patent is hereby corrected as shown below:

Column 5,
Line 17, "1800" should read -- 180º --.

Signed and Sealed this

Twenty-seventh Day of December, 2005

JON W. DUDAS
*Director of the United States Patent and Trademark Office*